US011384583B2

(12) United States Patent
Zimmer et al.

(10) Patent No.: US 11,384,583 B2
(45) Date of Patent: Jul. 12, 2022

(54) RETRACTION DEVICE FOR TWO END POSITIONS

(71) Applicants: Martin Zimmer, Rheinau (DE); Günther Zimmer, Rheinau (DE)

(72) Inventors: Martin Zimmer, Rheinau (DE); Günther Zimmer, Rheinau (DE)

( * ) Notice: Subject to any disclaimer, the term of this patent is extended or adjusted under 35 U.S.C. 154(b) by 0 days.

(21) Appl. No.: 17/284,877

(22) PCT Filed: Oct. 13, 2019

(86) PCT No.: PCT/DE2019/000267
§ 371 (c)(1),
(2) Date: Apr. 13, 2021

(87) PCT Pub. No.: WO2020/078496
PCT Pub. Date: Apr. 23, 2020

(65) Prior Publication Data

US 2021/0381293 A1 Dec. 9, 2021

(30) Foreign Application Priority Data

Oct. 14, 2018 (DE) ..... 10 2018 008 201.7

(51) Int. Cl.
*E05F 1/08* (2006.01)
*E05F 1/16* (2006.01)
*E05F 5/00* (2017.01)

(52) U.S. Cl.
CPC ..... *E05F 1/16* (2013.01); *E05F 5/003* (2013.01); *E05Y 2201/41* (2013.01);
(Continued)

(58) Field of Classification Search
CPC ..... E05F 5/003; E05F 5/05; E05F 1/08; E05F 1/1091; E05F 1/16; E05F 3/00; E05F 3/02; E05F 3/04; E05F 3/18; E05F 3/227; E05F 3/22; E05F 3/10; E05F 3/108; E05F 3/224; E05Y 2800/24; E05Y 2201/64;
(Continued)

(56) References Cited

U.S. PATENT DOCUMENTS 10,151,130 B2 * 12/2018 Wang ..... E05F 1/16
10,738,523 B2 * 8/2020 Wang ..... E05F 5/10
(Continued)

FOREIGN PATENT DOCUMENTS

CN 202170702 U 3/2012
DE 102008009046 A1 9/2009
(Continued)

*Primary Examiner* — Chuck Y Mah
(74) *Attorney, Agent, or Firm* — Smartpat PLC

(57) ABSTRACT

A retraction device for two end positions has two driving elements which are connected to one another by a spring energy accumulator. Each driving element is displaceably mounted in a respective guide housing. A sliding door has such a retraction device, and a sliding door arrangement has such a sliding door. Each driving element is coupled or can be coupled to a cylinder-piston unit mounted in the respective guide housing. Both guide housings are adjustable relative to one another in the longitudinal direction of the retraction device by means of at least one sliding joint. This provides a retraction device for two end positions, which can be used for a range of door widths without design modifications.

7 Claims, 4 Drawing Sheets

(52) U.S. Cl.
CPC ..... *E05Y 2600/14* (2013.01); *E05Y 2600/46* (2013.01); *E05Y 2900/132* (2013.01)

(58) Field of Classification Search
CPC ..... E05Y 2201/644; E05Y 2201/264; E05Y 2201/41; E05Y 2201/47; E05Y 2201/21; E05Y 2201/488; E05Y 2900/132; E05Y 2900/142; E05Y 2900/14; E05Y 2600/14; E05Y 2600/46; Y10T 16/27; Y10T 16/56; Y10T 16/61; Y10T 16/593; Y10T 16/276; Y10T 16/281
See application file for complete search history.

(56) References Cited

U.S. PATENT DOCUMENTS

| | | | | |
|---|---|---|---|---|
| 2010/0037525 | A1* | 2/2010 | Sato | E05B 17/0025 74/89.17 |
| 2011/0023370 | A1 | 2/2011 | Zimmer et al. | |
| 2016/0369547 | A1* | 12/2016 | Sato | E06B 3/4654 |
| 2017/0051548 | A1* | 2/2017 | Wang | E06B 3/4636 |

FOREIGN PATENT DOCUMENTS

| | | | | |
|---|---|---|---|---|
| DE | 202017100244 | U1 * | 3/2017 | A47K 3/34 |
| DE | 102017100250 | A1 * | 7/2018 | E05D 15/063 |
| JP | 2008190275 | | 8/2008 | |
| JP | 2017014761 | A * | 1/2017 | |

* cited by examiner

RETRACTION DEVICE FOR TWO END POSITIONS

CROSS-REFERENCE TO RELATED APPLICATION

This application is a national stage application, filed under 35 U.S.C. § 371, of International Patent Application No. PCT/DE2019/000267, filed on Oct. 13, 2019, which claims the benefit of German Patent Application No. 10 2018 008 201.7, filed Oct. 14, 2018.

TECHNICAL FIELD

The disclosure relates to a retraction device for two end positions having two driving elements which are connected to one another by a spring energy accumulator, wherein each driving element is displaceably mounted in a respective guide housing. The disclosure further relates to a sliding door having such a retraction device and to a sliding door arrangement having such a sliding door.

BACKGROUND

Such a device is known from DE 10 2008 009 046 A1. Unique cylinder-piston units are required to accommodate sliding doors of different widths, one for each width.

SUMMARY

The present disclosure is based on the problem of developing a retraction device for two end positions, which can be used for a range of door widths without design modifications.

This problem is resolved with the features of the main claim. For this purpose, each driving element is coupled or can be coupled to a cylinder-piston unit mounted in the respective guide housing. Both guide housings are adjustable relative to one another in the longitudinal direction of the retraction device by at least one sliding joint.

The retraction device has two cylinder-piston units and two guide housings. One cylinder-piston unit is mounted in each guide housing. Each of the two driving elements can be moved in each guide housing between a parked position and an end position. The individual driving element is coupled or can be coupled to an individual cylinder-piston unit. When the driving element moves from the parked position in the direction of the end position, such movement is decelerated or damped by the cylinder-piston unit. The deceleration or damping force is superimposed by the force of an unloading spring energy accumulator. Such spring energy accumulator is located between the two driving elements.

The two guide housings are adjustable relative to one another. For this purpose, the two guide housings are connected to one another by at least one sliding joint. Thereby the retraction device can be easily adapted to different door widths without the operator feeling any significant change in the amount of force required to operate the sliding doors.

Further details of the invention are given in the subclaims and the following description of schematically illustrated embodiments.

DETAILED DESCRIPTION

Figure 1:
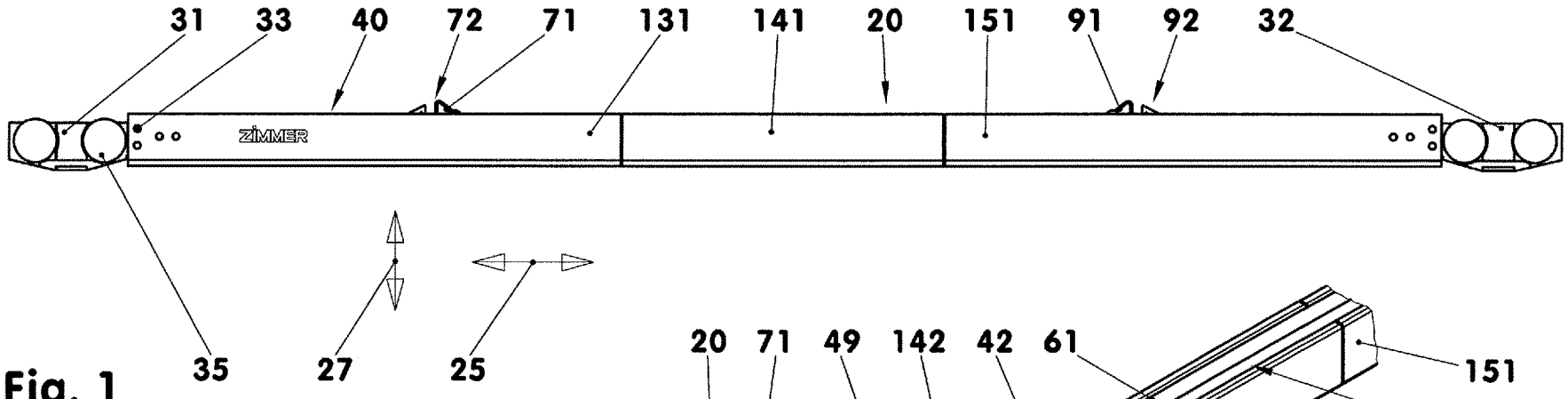
FIG. 1: Retraction device for two end positions.
Figure 10:
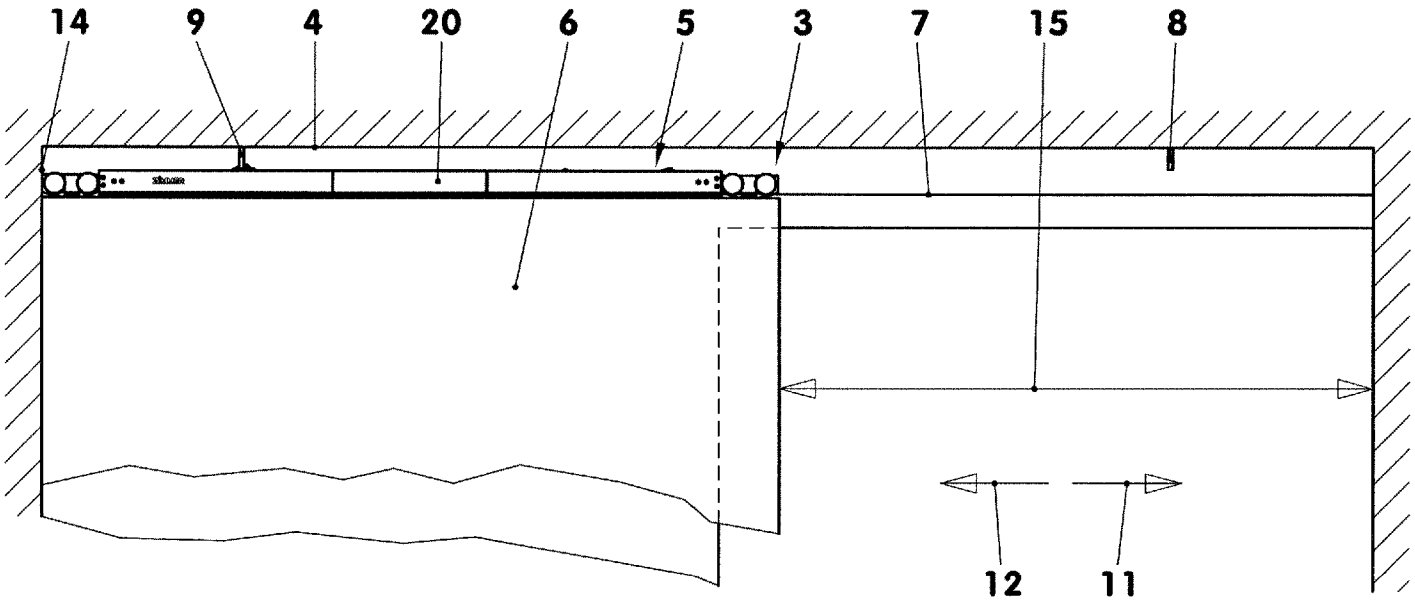
FIG. 10: Sliding door assembly with sliding door open.
Figure 11:
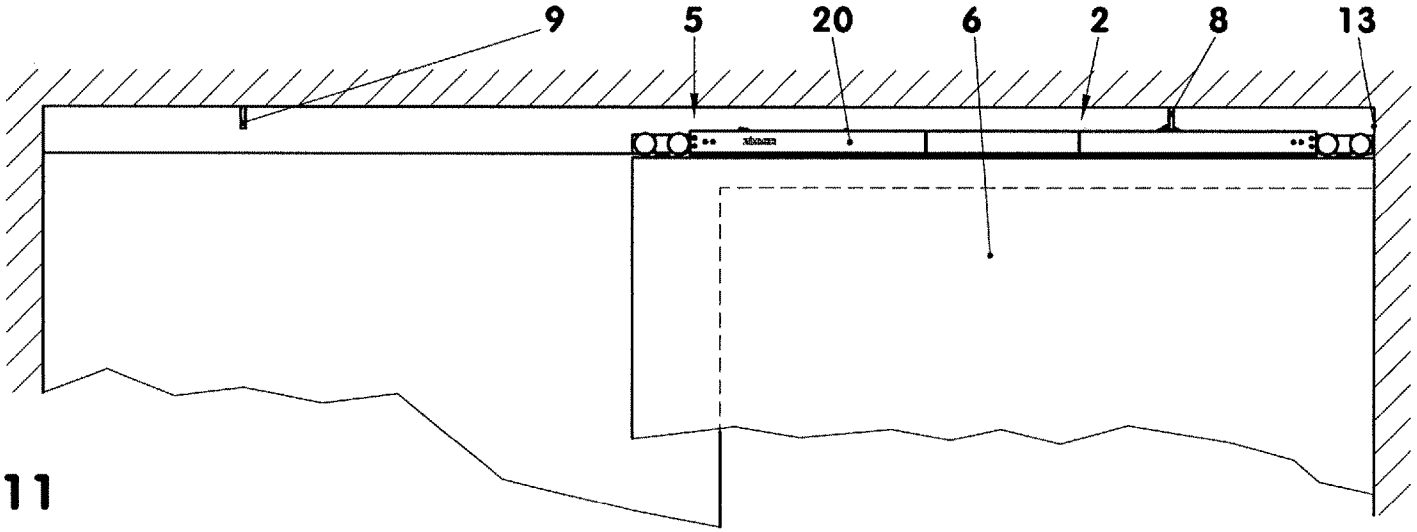
FIG. 11: Sliding door arrangement with closed sliding door.

FIG. 1 shows a retraction device (20) for two end positions (2, 3). Such retraction devices (20) are used, for example, to convey a sliding door (5) guided in a door frame (4) in a controlled manner into an open end position (3) and into a closed end position (2), see FIGS. 10 and 11.

The retraction device (20) has a device body (40) on which, in the exemplary embodiment, a guide carriage (31; 32) is arranged at each of the two ends oriented in the longitudinal direction (25). The respective guide carriage (31; 32) may be screwed to the fixture body (40) by screws (33). The retraction device (20) can also be formed without a guide carriage (31, 32). In this case, the device body (40) may be fastened directly to a sliding door leaf (6) of the sliding door (5). It is also conceivable to form the retraction device (20) for combination with different types of guide carriages (31, 32).

Figure 2:
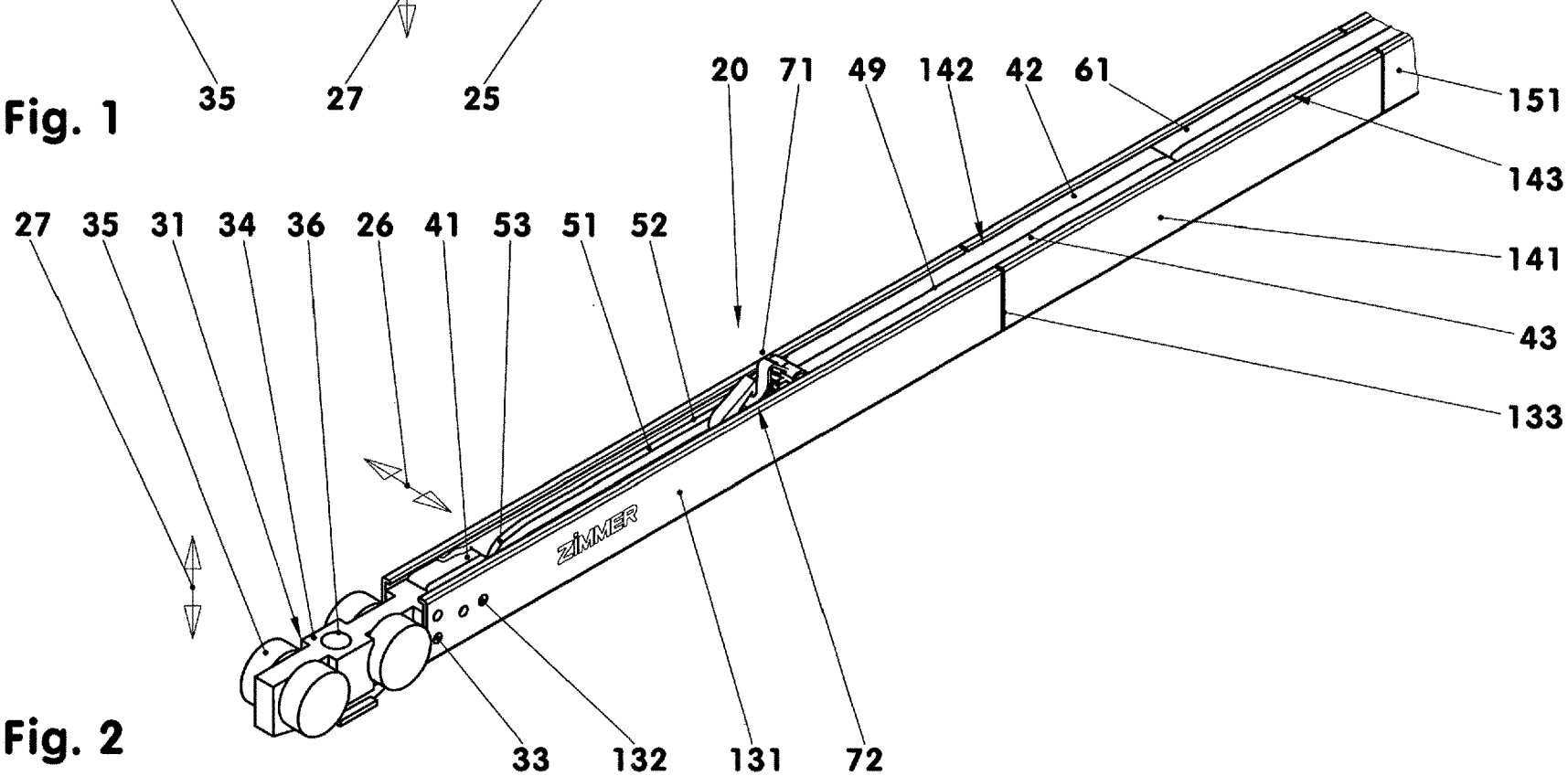
FIG. 2: Isometric partial view of the device from FIG. 1.

Each of the guide carriages (31, 32) shown in FIGS. 1 and 2 has a carrier part (34) on which two spaced pairs of rollers (35) are rotatably mounted. A fastening aperture (36) for receiving a fastening screw or a fastening bolt is provided between the pairs of rollers (35). Such fastening aperture may be oriented in the vertical direction.

The device body (40) has two guide housings (41, 61), in each of which a driving element (71; 91) is guided. In the exemplary embodiment, the two guide housings (41, 61) are formed to be identical to one another. In the device body (40), they are arranged in mirror image to a vertical center transverse plane. The two driving elements (71, 91) both project upwards from the device body (40) in the illustrations of FIGS. 1 and 2. In the illustrations, they are each in an end position (72; 92). The retraction device (20) can also be formed so that the driving elements (71, 91) are oriented transversely to the direction of the fastening apertures (36). The two driving elements (71, 91) can also project from the device body (40) on different longitudinal sides.

The individual guide housing (41; 61) comprises two guide shells (42, 43), which encompass the respective driving element (71; 91) in certain areas. In the exemplary embodiment, the joint (49) of the two guide shells (42, 43) lies in a vertical central longitudinal plane. Each of the guide shells (42; 43) has a guide track (51) for guiding the driving element (71; 91). The two guide shells (42, 43) are structured to be, for example, mirror-symmetrical to one another.

A mounting profile (131; 151) is fastened to the individual guide housing (41; 61), for example by mounting screws (132). In the exemplary embodiment, this is largely formed in a U-shape. For example, it is a drawn aluminum profile. It encompasses the lower side of the respective guide housing (41; 61). In the exemplary embodiment, the respective guide carriage (31; 32) is fastened in the mounting profiles (131, 151). For example, the length of the individual mounting profile (131; 151) is 37% of the length of the device body (40).

In the exemplary embodiment, a push profile (141) is arranged between the two mounting profiles (131, 151). The cross-section of the push profile (141) corresponds, for example, to the cross-section of the mounting profiles (131, 151). In the illustrations of FIGS. 1 and 2, the push profile (141) encompasses both guide housings (41, 61) on their lower side (46). The push profile (141) is not fastened to the guide housings (41, 61). For example, the two guide housings (41, 61) are supported on one another. There are gaps (133) between the push profile (141) and the shell profiles (131, 151). The push profile (141) can be moved by the length of such gap (133) relative to the mounting profiles (131, 151) and to the guide housings (41, 61). It is also conceivable, in the arrangement according to FIG. 1, to form the retraction device (20) without a gap (133) between the push profile (141) and the mounting profiles (131, 151). The push profile (141) then rests against both mounting profiles (131, 151). In this case, for example, the two guide housings (41, 61) are spaced apart from one another.

Figure 3:
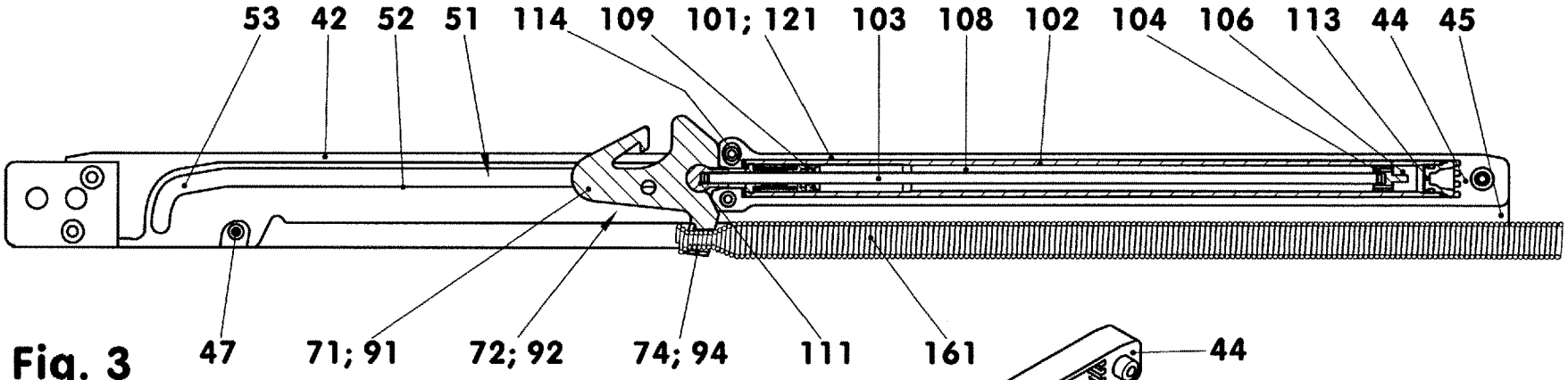
FIG. 3: Longitudinal section of the guide housing from FIG. 2.

FIG. 3 shows a partial longitudinal section of a guide housing (41; 61). The sectional plane of this illustration is a vertical central longitudinal plane of the retraction device (20). In this illustration, only one guide housing (41; 61) and only one driving element (71; 91) can be seen. In the guide housing (41; 61), the driving element (71; 91) is displaceably mounted between the end position (72; 92) shown and a parked position (73; 93) secured in a force-fitting and/or positive-locking manner. The two driving elements (71, 91) of a retraction device (20) are connected by a spring energy accumulator (161). In the exemplary embodiment, the spring energy accumulator (161) is formed as a tension spring (161). In each driving element (71; 91), such tension spring (161) is held in a spring holder (74; 94).

In the exemplary embodiment, the tension spring (161) has an installation length in the position of the driving elements (71, 91) shown in FIG. 1, which corresponds to twice the length of the fully relaxed tension spring (161). The maximum useful length of the tension spring (161) is, for example, three times the length of the fully released tension spring (161). The spring stiffness of the tension spring (161), for example, is between 0.03 newtons per millimeter and 0.3 newtons per millimeter.

A cylinder-piston unit (101; 121) is further mounted in the individual guide housing (41; 61). In the exemplary embodiment, this is a hydraulic cylinder-piston unit (101; 121). However, the retraction device (20) can also have two pneumatic cylinder-piston units (101; 121). It is also conceivable to use two cylinder-piston units (101; 121) operated with different media.

The individual cylinder-piston unit (101; 121) comprises a cylinder (102), in which a piston (104) movable by a piston rod (103) is mounted. The piston (104) has, for example, longitudinal channels, which can be at least largely closed, for example, by a throttle disk that can be lifted off and is turned towards the displacement chamber (106). In the cylinder (102), the piston (104) separates the displacement chamber (106) from a compensation chamber (108). In the compensation chamber (108), a compensation sealing element (109) is spring-loaded and displaceably mounted in the cylinder-piston unit (101; 121).

Figure 7:
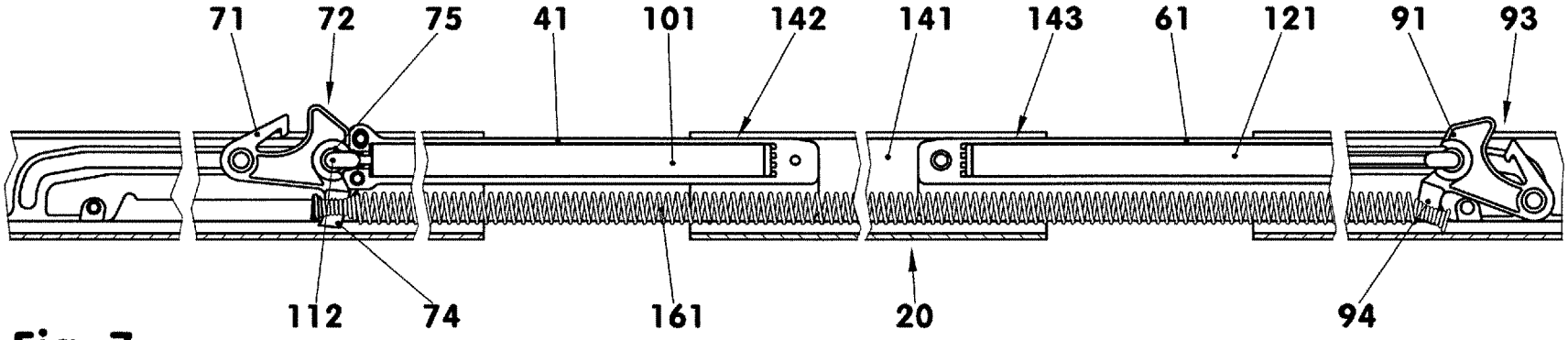
FIG. 7: Pulled apart retraction device.

In the illustration of FIG. 3, the piston rod (103) has a piston rod head (111) that is pivotally mounted in a piston rod head holder (75) of the driving element (71; 91). In this exemplary embodiment, the piston rod head (111) is formed with two lateral guide pins (112) with an oval cross-section, see FIG. 7. The guide pins (112) may also be cylindrical, elliptical, rectangular, square, etc., in cross-section. The individual cylinder-piston unit (101; 121) can also be formed with a return spring, for example, arranged in the displacement chamber (106) and formed as a compression spring. With a design with a return spring, the driving element (71; 91) can contact the piston rod (103) in a releasable manner. For example, if the driving element (71; 91) is moved quickly, it can be released from the piston rod (103).

The cylinder-piston unit (101; 121) can also be arranged in the guide housing (41; 61) in such a manner that the cylinder base (113) faces the driving element (71; 91). It can be connected to the driving element (71; 91). The cylinder (102) is then displaceably mounted in the guide housing (41; 61). In this case, the piston rod (103) rests against or is connected to the rear wall (44) of the guide housing (41; 61). The cylinder-piston unit (101; 121) can be designed as described above. With such an arrangement, transverse forces on the piston rod (103) can be largely avoided.

Figure 4:
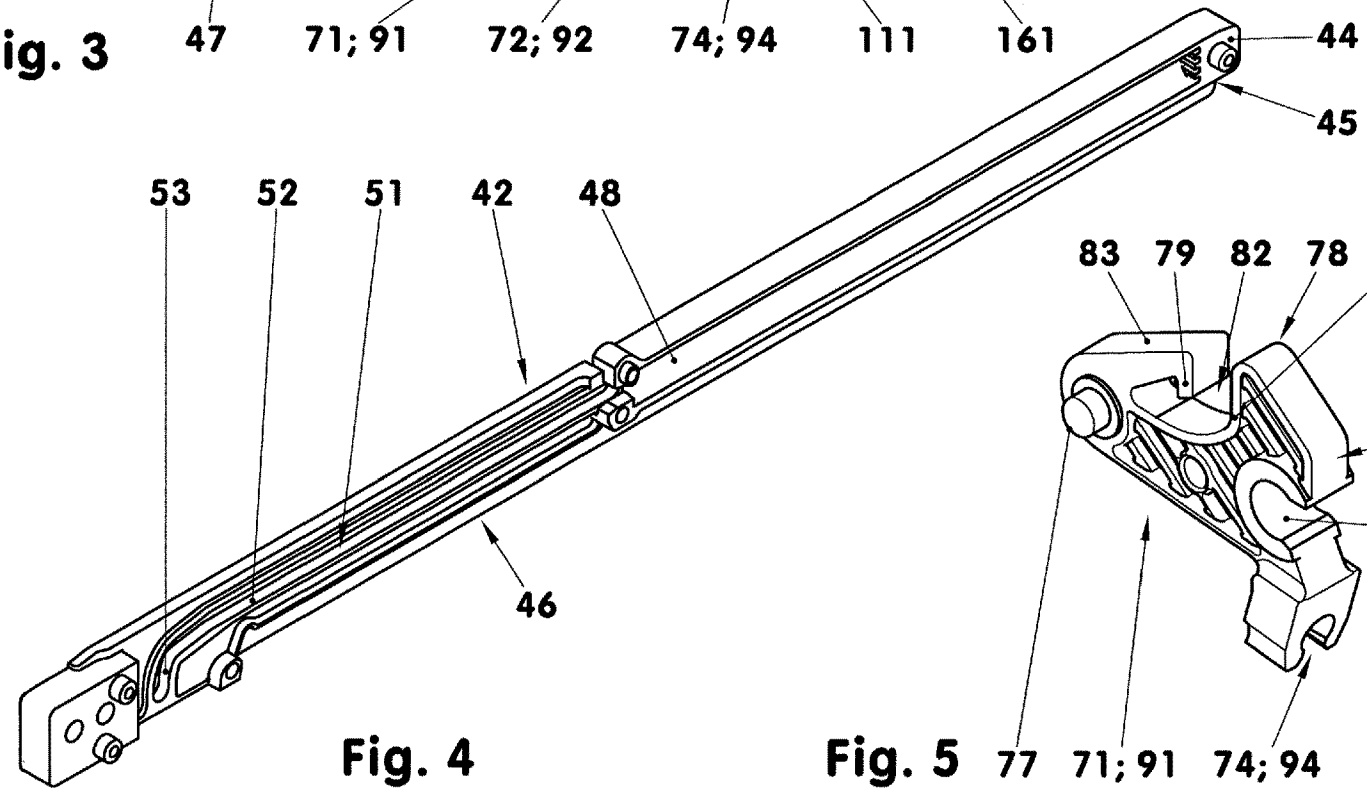
FIG. 4: Housing shell.

In FIG. 4, a housing shell (42; 43) is shown. The housing shell (42; 43) may have six fastening holes (47) in order to join such housing shell (42; 43) to the second housing shell (43; 42). Joining is carried out, for example, by screw plugs. However, bonding, welding, etc. of the two housing shells (42, 43) is also conceivable.

The individual housing shell (42; 43) has a cylinder holder (48) adjacent the rear wall (44) and a guide track (51). For example, a center line of the cylinder holder (48) oriented in the longitudinal direction (25) is aligned with a horizontal center plane of the guide track (51). In the lower area, the rear wall (44) has a rear wall opening (45).

The guide track (51) has a horizontal section (52) and a downwardly curved section (53) adjoining it. A tangent to the center line of the curved section (53) encloses an angle of, for example, 100 degrees with the center line of the horizontal area (52). The guide track (51) embossed in the housing shell (42; 43), for example, can also be formed as a guide slot. In this case, for example, the upper limit of the guide track (51) can be omitted, at least in certain areas.

Figure 5:
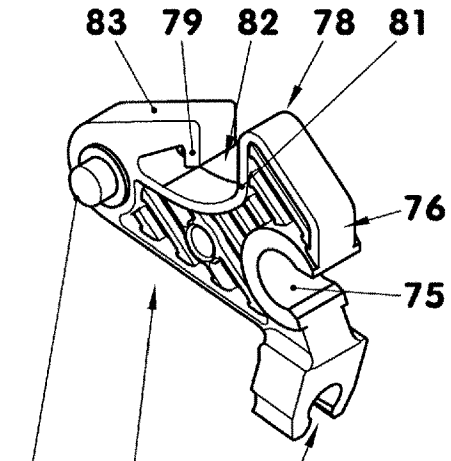
FIG. 5: Driving element.

FIG. 5 shows a driving element (71; 91) in an isometric view. In the exemplary embodiment, both driving elements (71; 91) are formed to be identical. The driving element (71; 91) has the piston rod head holder (75) located on one end face (76). This is aligned in a partially cylindrical manner. The cylinder axis is oriented in the transverse direction (26). The piston rod head holder (75) encompasses an angle of 240 degrees, for example. Such angle is symmetrical to the longitudinal direction (25) of the retraction device (20) when the driving element (71; 91) is in the end position.

In the area turned away from the piston rod head holder (75), the driving element (71; 91) has two coaxially aligned guide sticks (77) extending on opposite sides from the driving element (71; 91). These project laterally from the driving element (71; 91). In the exemplary embodiment, both guide sticks (77) are formed to be cylindrical and have a circular cross-section.

On its upper side (78), the driving element (71; 91) has two driving hooks (79, 81). Such driving hooks (79, 81) bound a driving recess (82) located between them. The driving hook (79) turned away from the piston rod head holder (75) is referred to below as a pull hook (79). The pull hook (79) is formed to be elastically deformable for an external load. The other driving hook (81) is referred to below as a push hook (81).

The driving element (71; 91) can also be formed with a swiveling or lowerable pull hook (79). For example, the guide track (51) or the guide slot can then be designed without a curved section. The pull hook (79) then slides along a guide ramp in certain areas, for example.

On its lower side, the driving element (71; 91) has the spring holder (74; 94). This is formed in a fork shape, for example. For example, it is arranged below the piston rod head holder (75).

When assembling the retraction device (20), for example, the cylinder-piston units (101; 121) and the driving elements (71; 91) coupled to the piston rod heads (111) are initially inserted into a guide shell (42; 43). Thereby, the guide pins (112) and the guide sticks (77) are inserted into the guide tracks (51). The tension spring (161) can be hooked into the spring holder (74; 94) of a driving element (71; 91). Now, both guide housings (41, 61) can be closed by fitting the second guide shell (43; 42).

For example, in a next step, both guide housings (41, 61) are inserted into the push profile (141) in such a manner that the rear walls (44) face one another. The tension spring (161) can now be guided within the push profile (141) to the second driving element (91; 71). There, the tension spring (161) is hooked into the spring holder (94; 74) of the second driving element (91; 71).

Next, the mounting profiles (131; 151) are pushed onto the guide housings (41; 61), for example from the outside, and fastened by means of the mounting screws (132). A guide carriage (31; 32) is inserted into each mounting profile (131; 151) and fastened by the screws (33). Another sequence of assembly is also conceivable.

Fastening bolts, for example, are inserted into the fastening apertures (36) of the guide carriages (31; 32). The retraction device (20) prepared in this way is then inserted, for example, into a door guide rail (7) on the frame side, such that the fastening bolts project downwards. The sliding door leaf (6) is attached to the fastening bolts. This, for example, has a mass between 120 kilograms and 160 kilograms. If the distance between the fastening bolts is shorter than the distance between the bolt receptacles provided on the sliding door leaf (6), the retraction device (20) can be pulled apart telescopically for adjustment, see FIG. 7. In this simplified illustration, the mounting profiles (131, 151) and the push profile (141) are shown in longitudinal section and two guide shells (42; 43) have been removed.

Figure 6:
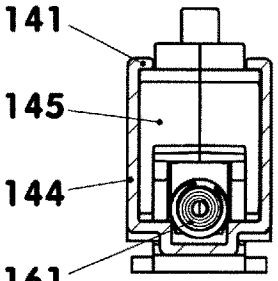
FIG. 6: Cross-section of the retraction device.

Together with the two guide housings (41; 61), the push profile (141) forms two sliding joints (142, 143). FIG. 6 shows a cross-section of the retraction device (20), wherein the section plane is the vertical center transverse plane of the retraction device (20). Each sliding joint (142; 143) is formed by a pair of prisms (144, 145) consisting of a hollow prism (144) and a solid prism (145). In this exemplary embodiment, each guide housing (41; 61) forms a solid prism (145), which is linearly slidably movable in the push profile (141) forming a hollow prism (144). Thereby, the guide surfaces are flat surfaces that lie flat against one another. Thereby, for example, the overlap length of the two prisms (144, 145) is greater in the longitudinal direction (25) than in the transverse direction (26) and greater than in the height direction (27). Such bearing arrangement with degrees of freedom oriented only in the longitudinal direction (25) prevents the tilting of the sliding joint (142; 143).

The individual sliding joint (142; 143) can also have a cylindrical cross-section. It is also conceivable to couple both guide housings (41; 61) to one another in a sliding joint (142; 143). With one such embodiment, the telescoping retraction device (20) can be formed with an individual sliding joint (142; 143).

The individual sliding joint (142; 143) can be lockable in the longitudinal direction (25). Thereby, the sliding joint (142; 143) can be fixed in steps or in stepless form at least secondarily. In the case of locking in steps, the individual prism (144; 145) can engage in recesses in the joint partner (145; 144), for example, by means of a spring-loaded ball, latching elements, etc. In the case of stepless adjustment of the sliding joint (142; 143), this can be locked, for example, by a wedge-shaped mounting aid, a friction surface, molded-on ribs or by means of a screw drive. It is also conceivable to fix the sliding joint (142; 143), for example, by a fixing screw screwed into the push profile (141). For example, a pair of cylindrically shaped elements can be fixed in place by a clamping nut overlapping the hollow prism (144). The use of clamping elements, bayonet connections, quick-locking elements, intermediate buffers, etc. is also conceivable.

With such an embodiment, the length of the retraction device (20) can be adapted to the length of the sliding door leaf (6) before it is mounted in the frame. After inserting the retraction device (20) into the door guide rail (7) on the frame side, the sliding door leaf (6) can be attached to the retraction device (20) and fastened without any further adjustment work.

It is also conceivable to insert the sliding door leaf (6) together with the retraction device (20) fastened to it into the door guide rail (7) on the frame side. Due to the telescopic retraction device (20), the retraction device (20) shown in the exemplary embodiment can be used, for example, for sliding doors (5) whose length is up to 1.15 times a nominal length. Thereby, the nominal length of the sliding door (5) is determined by the basic length of the retraction device (20) in the retracted position, see FIG. 1. Depending on the design of the sliding joint (142; 143) and the tension spring (161), however, it is also conceivable to use the retraction device (20) for sliding doors (5) whose length is 1.5 times the nominal length.

After the sliding door (5) has been mounted in the door frame (4), the driving elements (71; 91) have, for example, the position shown in FIG. 1. Both driving elements (71; 91) are in their respective end positions (72; 92). The two drive elements (71; 91) have, for example, identical distances from the respective end face of the sliding door leaf (6). The spring energy accumulator (161) is unloaded to a residual energy value. The tension spring (161) has its minimum operating length. Both cylinder-piston units (101; 121) are retracted. For example, the sliding door (5) is in a center position of its total stroke. Two drivers (8, 9) are arranged in or on the door guide rail (7) on the frame side. A first driver (8) is oriented in the closing direction (11), and a second driver (9) is oriented in the opening direction (12). Thereby, for example, the first driver (8) is at the same distance from the vertical frame (13) for the closed sliding door (5) as the second driver (9) is from the vertical frame of the open door (14), see FIGS. 10 and 11.

When the sliding door (5) is closed for the first time, the sliding door leaf (6) with the retraction device (20) seated on it is moved in the closing direction (11). The driving element (91; 71), which is on the right in the illustrations of FIGS. 10 and 11, abuts against the first driver (8) with the outer side (83) of the pull hook (79). When the sliding door (5) is closed further, the tension hook (79) is elastically deformed. The driver (8) jumps into the driver recess (82) and engages there. The sliding door (5) is now closed.

When the sliding door (5) is opened for the first time, the sliding door (5) pulls the guide housing (61; 41) relative to the driving element (91; 71) in the opening direction (12). The driving element (91; 71) moves along the guide track (51). The piston rod (103) of the cylinder-piston unit (121; 101) is extended or moves out under spring load. Thereby, for example, oil is displaced from the compensation chamber (108) into the displacement chamber (106). Due to the low spring rate of the tension spring (161), the operator experiences only slight resistance. For example, the force to be applied by the operator is less than 60 newtons. As soon as the guide sticks (77) of this driving element (91; 71) reach the curved section (53), the driving element (91; 71) is pivoted around the piston rod head (51) with the guide pins (112). The driving element (91; 71) is released from the driver (8). It is secured in a parked position (93; 73) in a force-fitting and/or positive-locking manner. Due to the low forces, the operator does not experience a jump in force.

Figure 8:
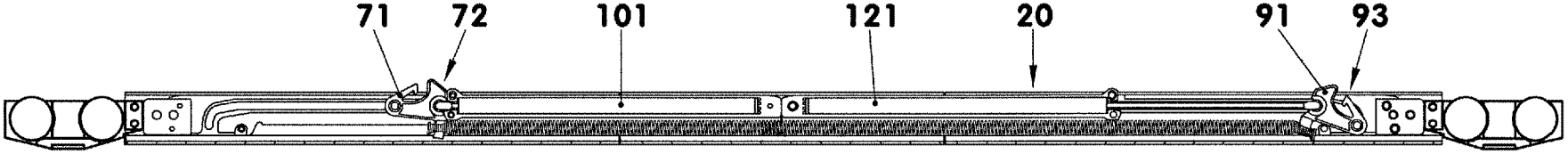
FIG. 8: Retraction device in a door end position.

The retraction device (20) is now in the position shown in FIG. 8, for example. The retraction device (20) is shown in this FIG. 8 in its retracted nominal length. The driving element (91; 71) shown on the right is in the parked position (93; 73). The cylinder-piston unit (121; 101) shown on the right is extended. The driving element (71; 91) shown on the left is in the end position (72; 92). The cylinder-piston unit (101: 121) is retracted. The tension spring (161) is stretched to a second operating length. The second operating length is longer than the minimum operating length.

The sliding door (5) can now be opened further in the opening direction (12) to an open end position (3). When first opened, the driver (9) shown on the left in FIGS. 10 and 11 engages with the driving element (71; 91) shown on the left. This is done in the same way as described in connection with the engagement of the other driving element (91; 71) with the driver (8) oriented in the closing direction. After engagement, the driving elements (71; 91) continue to be in the position shown in FIG. 8. The sliding door (5) with the retraction device (20) is now ready for use.

When the sliding door (5) is closed again, the guide housing (41) shown on the left moves relative to the driving element (71; 91) held by the driver (9) shown on the left. The piston rod (103) of the cylinder-piston unit (101; 121) shown on the left is extended or is pushed out by the return spring. As soon as the driving element (71; 91) has reached its parked position (73; 93), the driver (9) is decoupled.

Figure 9:
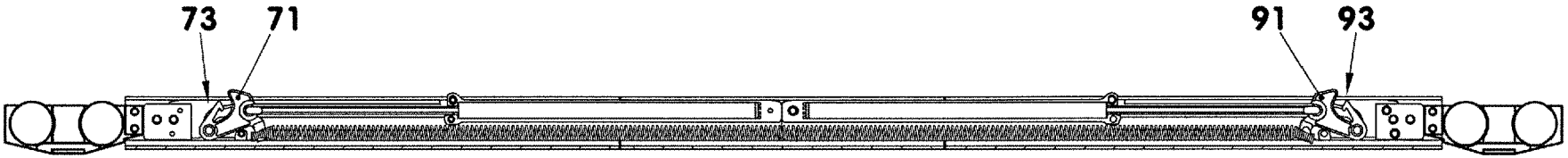
FIG. 9: Retraction device in a door center position.

FIG. 9 shows the retraction device (20) with both driving elements (71; 91) in the parked positions (73; 93). The tension spring (161) now has its maximum operating length at the nominal length of the retraction device (20). Both cylinder-piston units (101; 121) are extended. The sliding door (5) can now be closed further or opened again with almost no resistance.

For example, during further closing, the driving element (91; 71) shown on the right contacts the driver (8) arranged adjacent to the vertical frame (13) for the closed sliding door. The driving element (91; 71) shown on the right is released from the parked position (93; 73). The driving element (91; 71) loads the piston rod (103) of the cylinder-piston unit (121; 101) shown on the right. The piston (104) is retracted, wherein, for example, oil is displaced from the displacement chamber (106) into the compensation chamber (108) in a throttled manner, for example. The closing of the sliding door (5) is delayed. At the same time, the tension spring (161) is relieved. The acceleration force of the spring energy accumulator (161) and the deceleration force of the cylinder-piston unit (121; 101) are superimposed. The sliding door (5) is slowly pulled into the closed end position (2). It stops there. In the retraction device (20), the driving element (91; 71) shown on the right is now again in the end position (92; 72), while the other driving element (71; 91) remains in the parked position (73; 93).

When opening in the direction of the open end position (3), in a partial stroke of the total stroke (15) of the sliding door (5) adjacent to the open end position (3), the driving element (71; 91) shown on the left engages with the driver (9) adjacent to the vertical frame (14) for the open sliding door (5). When this open end position (3) is approached, the sliding door (5) is braked in the same way as when the closed end position (2) is approached. It thus moves in a controlled manner to the open end position (3).

The retraction device (20) can also be arranged on the frame side. Two drivers are then arranged on the sliding door, for example. In this case, for example, the guide housings (41: 61) face one another with their end faces turned away from the rear wall (44). In the cylinder-piston units (101, 121), the displacement chamber (106) is located between the piston (104) and the cylinder head (114). The tension spring (161) is guided, for example, around two deflection rollers arranged on the rear walls (44). Thus, the respective parked positions (73; 93) of the retraction device (20) are on the inside and the end positions (72; 92) are on the outside. The function of such a retraction device is as described above.

The sliding door (5) can also be electrically driven or can have an assisting electric drive. This can be used both when opening and closing the sliding door (5).

Combinations of the individual exemplary embodiments are also conceivable.

LIST OF REFERENCE SIGNS

2 Closed end position
3 Open end position
4 Door frame
5 Sliding door
6 Sliding door leaf
7 Guide rail, door guide rail
8 Driver
9 Driver
11 Closing direction
12 Opening direction
13 Vertical frame for the closed sliding door
14 Vertical frame for the open sliding door
15 Door stroke
20 Retraction device
25 Longitudinal direction
26 Transverse direction
27 Height direction
31 Guide carriage
32 Guide carriage
33 Screws
34 Carrier part
35 Pair of rollers
36 Fastening aperture
40 Device body
41 Guide housing
42 Guide shell, housing shell
43 Guide shell, housing shell
44 Rear wall
45 Rear wall opening
46 Lower side
47 Fastening holes
48 Cylinder holder
49 Joint
51 Guide track
52 Horizontal section
53 Curved section
61 Guide housing
71 Driving element
72 End position

73 Parked position
74 Spring holder
75 Piston rod holder, piston rod head holder
76 End face
77 Guide pins
78 Upper side
79 Driving hook, pull hook
81 Driving hook, push hook
82 Driving recess
83 Outer side of (79)
91 Driving element
92 End position
93 Parked position
94 Spring holder
101 Cylinder-piston unit
102 Cylinder
103 Piston rod
104 Piston
106 Displacement chamber
108 Compensation chamber
109 Compensation sealing element
111 Piston rod head
112 Guide pin
113 Cylinder base
114 Cylinder head
121 Second cylinder-piston unit
131 Mounting profile
132 Mounting screws
133 Gaps
141 Push profile
142 Sliding joint
143 Sliding joint
144 Hollow prism, part of a pair of prisms
145 Solid prism, part of a pair of prisms
151 Mounting profile
161 Spring energy accumulator, tension spring

The invention claimed is:

1. A retraction device (20) for two end positions (2, 3), comprising:

two driving elements (71, 91) which are connected to one another by a spring energy accumulator (161), each driving element (71; 91) being displaceably mounted in a respective guide housing (41; 61), wherein each driving element (71; 91) is coupled or can be coupled to a cylinder-piston unit (101; 121) mounted in the respective guide housing (41; 61), and wherein the guide housings (41, 61) are adjustable relative to one another in a longitudinal direction (25) of the retraction device (20) by two sliding joints (142; 143), wherein each of the two sliding joints (142; 143) comprises a solid prism (145) and a hollow prism (144) encompassing the solid prism (145), wherein each of the guide housings (41; 61) forms the solid prism (145) and is linearly slidably movable in a push profile (141), the push profile (141) comprising the respective hollow prism (144).

2. The retraction device (20) according to claim 1, wherein each sliding joint (142; 143) is lockable in at least two positions in a force-fitting and/or positive-locking manner.

3. The retraction device (20) according to claim 1, wherein a guide carriage (31; 32) with at least one pair of rollers (35) is allocated to each guide housing (41; 61).

4. The retraction device (20) according to claim 1, further comprising fastening pins projecting perpendicularly to the longitudinal direction (25) for mounting the retraction device (20) on a sliding door leaf (6).

5. The retraction device (20) of claim 1, wherein the spring energy accumulator (161) is a tension spring (161) having a spring stiffness between 0.03 newtons per millimeter and 0.3 newtons per millimeter.

6. A sliding door (5) with a sliding door leaf (6) and the retraction device (20) according to claim 1.

7. A sliding door arrangement with the sliding door (5) according to claim 6, with a door frame (4) and with two drivers (8; 9) arranged in the door frame (4), each of which can be coupled to one of the driving elements (71; 91).

* * * * *